US008201364B1

(12) United States Patent
Tomas

(10) Patent No.: US 8,201,364 B1
(45) Date of Patent: Jun. 19, 2012

(54) RIGID COMPONENT SYSTEM

(76) Inventor: Cedo Tomas, St. Petersburg, FL (US)

( * ) Notice: Subject to any disclaimer, the term of this patent is extended or adjusted under 35 U.S.C. 154(b) by 112 days.

(21) Appl. No.: 12/660,628

(22) Filed: Mar. 2, 2010

Related U.S. Application Data

(60) Provisional application No. 61/209,408, filed on Mar. 6, 2009.

(51) Int. Cl.
*E04D 1/24* (2006.01)
*E04D 1/28* (2006.01)

(52) U.S. Cl. ..... 52/90.2; 52/91.1; 52/411; 52/81.1; 52/409; 52/13

(58) Field of Classification Search ..... 52/411, 52/410, 409, 81.2, 798.1, 13, 82, 83, 81.1, 52/90.2, 91.1; 446/102, 106
See application file for complete search history.

(56) References Cited

U.S. PATENT DOCUMENTS 1,266,574 A * 5/1918 Ford ..... 52/411
1,429,740 A * 9/1922 Jordan ..... 52/411
1,449,340 A * 3/1923 Menzer ..... 264/34
1,708,462 A * 4/1929 Bodman ..... 52/591.1
2,848,764 A * 8/1958 Turteltaub ..... 52/75
3,676,880 A 7/1972 Kwake
3,828,492 A * 8/1974 Schliemann et al. ..... 52/36.2
3,924,738 A * 12/1975 Poupitch ..... 206/150
3,959,937 A * 6/1976 Spunt ..... 52/81.2
D304,213 S * 10/1989 Chen ..... D21/488
5,361,919 A * 11/1994 Hull et al. ..... 215/228
5,509,426 A 4/1996 Roddy
5,895,536 A * 4/1999 Starr et al. ..... 156/71
6,196,216 B1 3/2001 Kooij
6,618,988 B2 9/2003 Williams et al.
2008/0010933 A1 * 1/2008 Faulkner et al. ..... 52/411

* cited by examiner

*Primary Examiner* — Phi Dieu Tran A

(57) ABSTRACT

A rigid component is formed of a plurality of coupled cylinders. Each cylinder has a circular cross sectional configuration with an axis, a top, a bottom, first and second sides and a slit. The coupled cylinders have parallel axes and include an upper plane with the axes in a common upper plane and a lower plane with the axes in a common lower plane. The slits face downwardly in the upper plane and upwardly in the lower plane. The slits receive a side of each of its adjacent cylinders. The cylinders are secured with respect to each other by the resilience of the cylinders at their slits holding the sides of the cylinders passing through the slits.

5 Claims, 3 Drawing Sheets

FIG 1
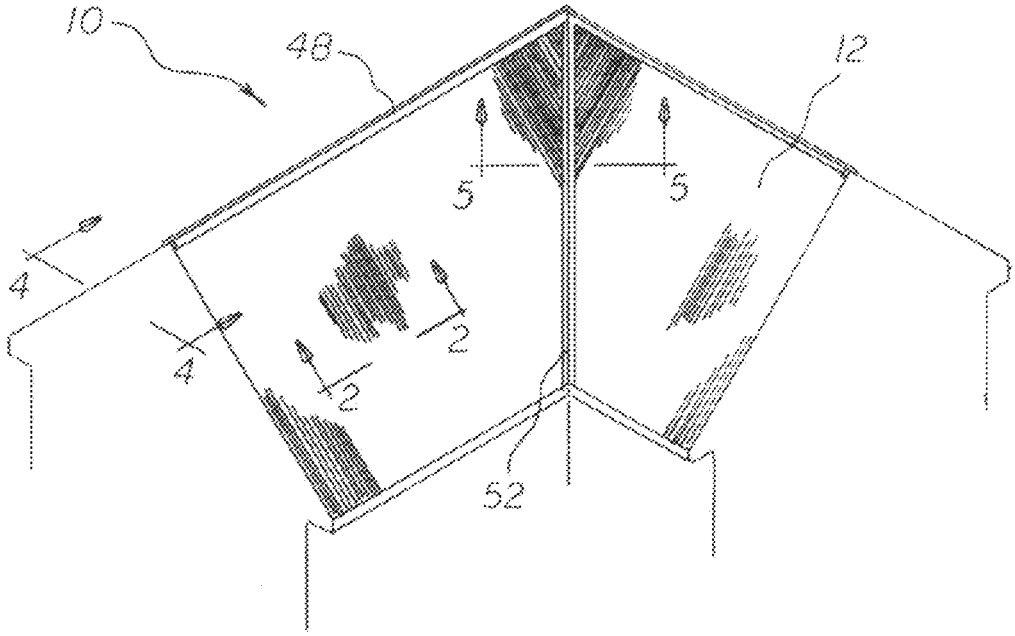
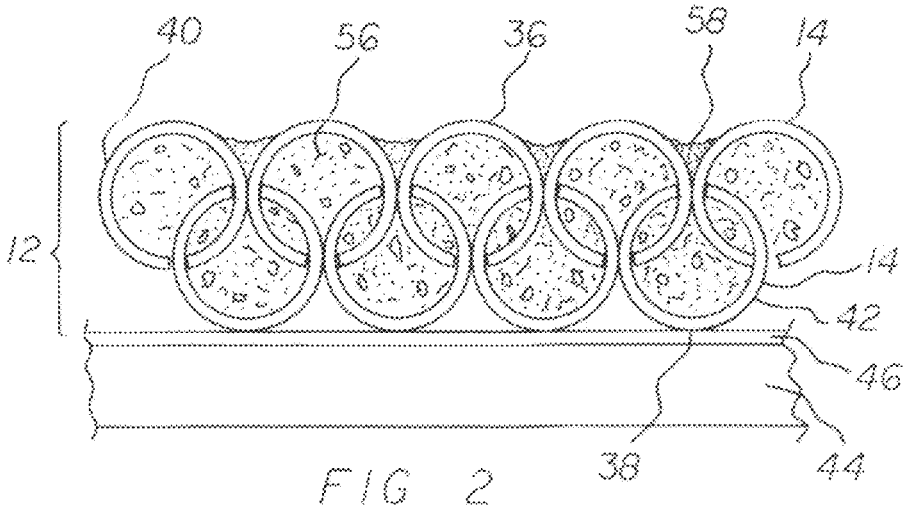
FIG 2

FIG 3
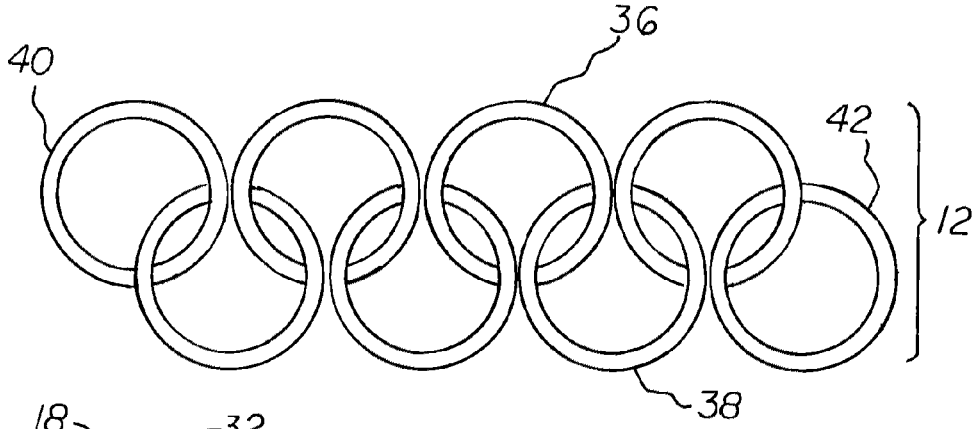
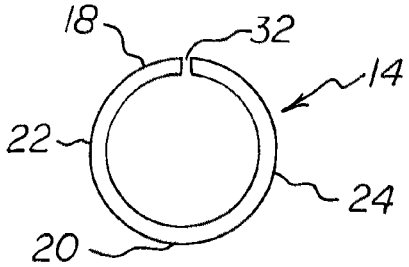
FIG 3A
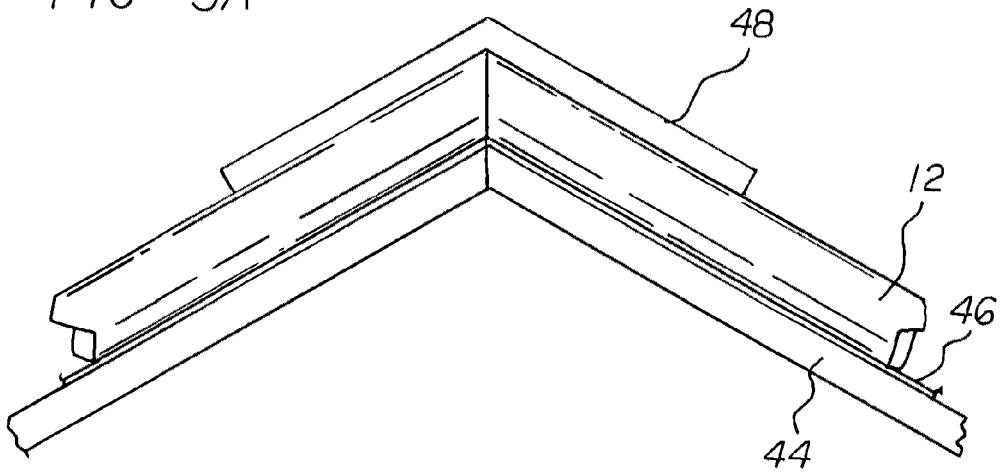
FIG 4

FIG 5
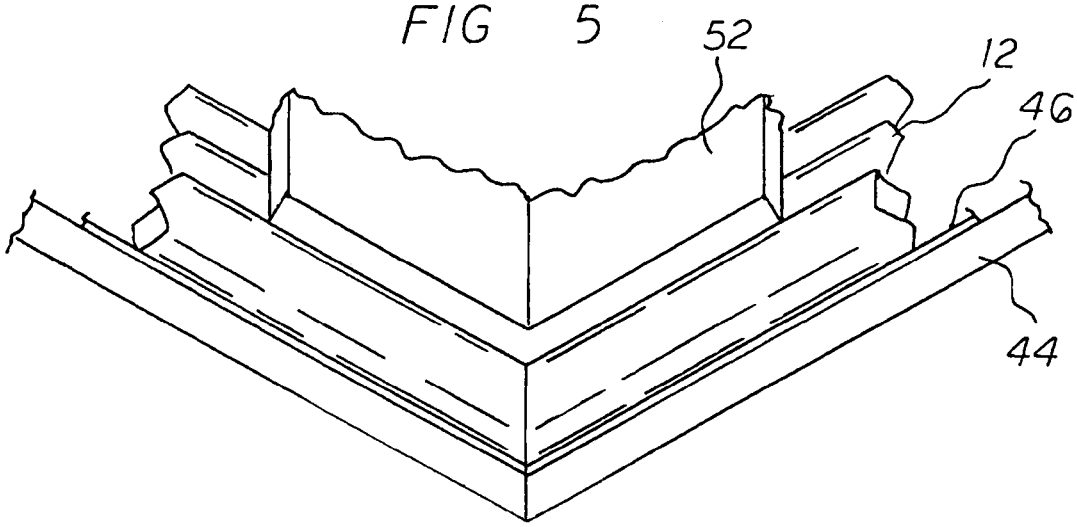
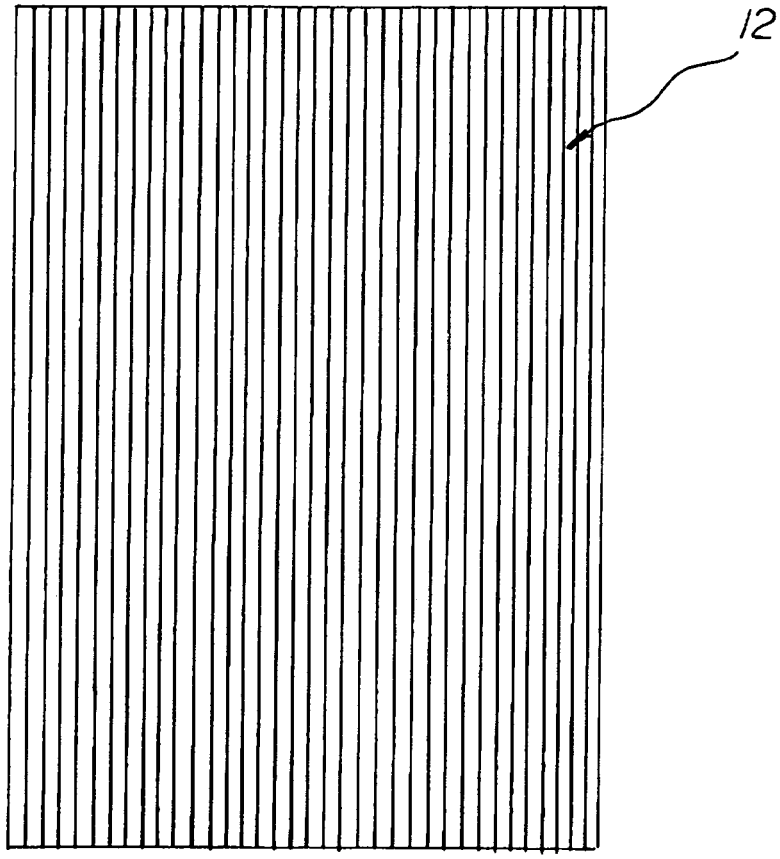
FIG 6

RIGID COMPONENT SYSTEM

RELATED APPLICATION

This application is based upon and claims the benefit of Provisional Patent Application Ser. No. 61/209,408 filed Mar. 6, 2009, the subject matter of which is incorporated herein by reference.

BACKGROUND OF THE INVENTION

1. Field of the Invention

The present invention relates to a rigid component system and more particularly pertains to providing a rigid component for roofing and other applications.

2. Description of the Prior Art

The use of rigid component systems of known designs and configurations is known in the prior art. More specifically, rigid component systems of known designs and configurations previously devised and utilized are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,618,988 issued Sep. 16, 2003, discloses a Lightweight Greenhouse Structure for Rapid Assembly, Disassembly, Storage and Transport. U.S. Pat. No. 5,509,426 issued Apr. 23, 1996 to Roddy discloses a Solar Roof Shingle. U.S. Pat. No. 3,676,880 issued Jul. 18, 1972 to Kwake discloses an Inflatable Enclosure for Swimming Pools and the Like. Lastly, U.S. Pat. No. 6,196,216 issued Mar. 6, 2001, to Kooij discloses a Solar Collector and Method for Manufacture thereof.

While the prior art devices fulfill their respective, particular objectives and requirements, they do not describe a rigid component system that provides a rigid component for roofing and other applications.

In this respect, the rigid component system according to the present invention substantially departs from the conventional concepts and designs of the prior art, and in doing so provides an apparatus primarily developed for the purpose of providing a rigid component for roofing and other applications.

Therefore, it can be appreciated that there exists a continuing need for a new and improved rigid component system which provides a rigid component for roofing and other applications. In this regard, the present invention substantially fulfills this need.

SUMMARY OF THE INVENTION

In view of the foregoing disadvantages inherent in the known types of rigid component systems of known designs and configurations now present in the prior art, the present invention provides an improved rigid component system. As such, the general purpose of the present invention, which will be described subsequently in greater detail, is to provide a new and improved rigid component system and method which has all the advantages of the prior art and none of the disadvantages.

To attain this, the present invention essentially comprises a rigid component system for building structures which is safe, convenient and economical. First provided is a plurality of essentially rigid components. Each rigid component is formed of a plurality of cylinders. Each of the cylinders is of a same size and shape. Each of the cylinders has a circular cross sectional configuration with a central axis. Each of the cylinders has an exterior diameter of between 0.750 inches and 1.125 inches. Each of the cylinders has a side wall with a thickness of between 0.125 inches and 0.250 inches. Each of the cylinders has a top, a bottom, a first side, and a second side. An axial slit is formed in each cylinder.

Each rigid component is formed by coupling a plurality of the cylinders. The coupled cylinders have their axes parallel with each other. The coupled cylinders include an upper plane of cylinders with the axes being in a common upper plane. The coupled cylinders include a lower plane with the axes of the cylinders being in a common lower plane. The coupled cylinders of each plane include two endmost cylinders and a plurality of intermediate cylinders between the endmost cylinders.

The slits of the coupled cylinders face downwardly in the upper plane. The slits face upwardly in the lower plane. The slits of each of the endmost cylinders receive one of the sides of its adjacent cylinder. The slit of each of the intermediate cylinders receives one of the sides of each of its adjacent cylinders. The cylinders are secured with respect to each other by the resilience of the cylinders at their slits holding the sides of the cylinders passing through the slits. In this manner, all of the cylinders are held together forming the rigid component for functioning as a roof covering. The construction and the coupling of the cylinders functions to provide a water resistant surface.

Next, a thermally insulating polymer is provided. The polymer is in the voids interior of the cylinders. The polymer functions as an insulator for a building located beneath the rigid components.

Each rigid component has an upper edge and an opposed lower edge. Each rigid component has a side edge and an opposed side edge. Each rigid component is adapted to be positioned upon an liquid impervious adhesive underlayment. The adhesive underlayment is positioned on roof decking and functions to hold the rigid components in place.

Next provided is a V-shaped roof ridge cover. The V-shaped roof ridge cover is placed over the upper edge of one of the rigid components and the upper edge of an adjacent rigid component.

Next provided is a V-shaped roof valley cover. The V-shaped roof ridge cover is placed over the side edge of one of the rigid components and the side edge of an adjacent rigid component.

Lastly, a liquid impervious adhesive is provided over the upwardly facing slits. This is an optional feature which adds to the structural rigidity of the system.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved rigid component system which has all of the advantages of the prior art rigid component systems of known designs and configurations and none of the disadvantages.

It is another object of the present invention to provide a new and improved rigid component system which may be easily and efficiently manufactured and marketed.

It is further object of the present invention to provide a new and improved rigid component system which is of durable and reliable constructions.

An even further object of the present invention is to provide a new and improved rigid component system which is susceptible of a low cost of manufacture with regard to both materials and labor, and which accordingly is then susceptible of low prices of sale to the consuming public, thereby making such rigid component system economically available to the buying public.

Even still another object of the present invention is to provide a rigid component system for providing a rigid component for roofing and other applications.

Lastly, it is an object of the present invention to provide a new and improved rigid component formed of a plurality of coupled cylinders. Each cylinder has a circular cross sectional configuration with an axis, a top, a bottom, first and second sides and a slit. The coupled cylinders have parallel axes and include an upper plane with the axes in a common upper plane and a lower plane with the axes in a common lower plane. The slits face downwardly in the upper plane and upwardly in the lower plane. The slits receive a side of each of its adjacent cylinders. The cylinders are secured with respect to each other by the resilience of the cylinders at their slits holding the sides of the cylinders passing through the slits.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of a roof system constructed in accordance with the principles of the present invention.

FIG. 2 is a cross sectional view taken along line 2-2 of FIG. 1.

FIG. 3 is a cross sectional view similar to FIG. 2 but illustrating an alternate embodiment of the invention.

FIG. 3A is a cross sectional view of one of the cylinders of the present invention.

FIG. 4 is a cross sectional view taken along line 4-4 of FIG. 1.

FIG. 5 is a cross sectional view taken along line 5-5 of FIG. 1.

FIG. 6 is a plan view of coupled cylinders forming a rigid component prior to being configured for increased utility.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved rigid component system embodying the principles and concepts of the present invention and generally designated by the reference numeral 10 will be described.

The present invention, the rigid component system 10 is comprised of a plurality of components. Such components in their broadest context include a plurality of cylinders with slits coupled to form a rigid component. Such components are individually configured and correlated with respect to each other so as to attain the desired objective.

The roof system 10 of the present invention is for building structures which is safe, convenient and economical. First provided is a plurality of essentially rigid components 12. Each rigid component is formed of a plurality of cylinders 14. Each of the cylinders is of a same size and shape. Each of the cylinders has a circular cross sectional configuration with a central axis. Each of the cylinders has an exterior diameter of between 0.750 inches and 1.125 inches. Each of the cylinders has a side wall with a thickness of between 0.125 inches and 0.250 inches. Each of the cylinders has a top 18, a bottom 20, a first side 22, and a second side 24. An axial slit 32 is formed in each cylinder.

Each rigid component is formed by coupling a plurality of the cylinders. The coupled cylinders have their axes parallel with each other. The coupled cylinders include an upper plane of cylinders with the axes being in a common upper plane. The coupled cylinders include a lower plane with the axes of the cylinders being in a common lower plane. The coupled cylinders of each plane include two endmost cylinders and a plurality of intermediate cylinders between the endmost cylinders.

The slits of the coupled cylinders face downwardly in the upper plane. The slits face upwardly in the lower plane. The slits of each of the endmost cylinders receive one of the sides of its adjacent cylinder. The slit of each of the intermediate cylinders receives one of the sides of each of its adjacent cylinders. The cylinders are secured with respect to each other by the resilience of the cylinders at their slits holding the sides of the cylinders passing through the slits. In this manner, all of the cylinders are held together forming the rigid component for functioning as a roof covering. The construction and the coupling of the cylinders functions to provide a water resistant surface.

Next, a thermally insulating polymer 56 is provided. The polymer is in the voids interior of the cylinders. The polymer functions as an insulator for a building located beneath the rigid components.

Each rigid component has an upper edge 36 and an opposed lower edge 38. Each rigid component has a side edge 40 and an opposed side edge 42. Each rigid component is adapted to be positioned upon an liquid impervious adhesive underlayment 46. The adhesive underlayment is positioned on roof decking 44 and functions to hold the rigid components in place.

Next provided is a V-shaped roof ridge cover 48. The V-shaped roof ridge cover is placed over the upper edge of one of the rigid components and the upper edge of an adjacent rigid component.

Next provided is a V-shaped roof valley cover 52. The V-shaped roof ridge cover is placed over the side edge of one of the rigid components and the side edge of an adjacent rigid component.

Lastly, a liquid impervious adhesive 58 is provided over the upwardly facing slits. This is an optional feature which adds to the structural rigidity of the system.

An alternate embodiment of the invention is shown in FIG. 3. As in the prior embodiment, a rigid component is formed by coupling the cylinders. In this embodiment, the cylinders are coupled forming upper and lower planes and the thermally insulating polymer is absent.

The rigid component of the present invention may be configured with or without the thermally insulating polymer and/or the liquid impervious adhesive. The cylinders used can be as few as three forming a rigid component. The rigid component's use is not restricted to roofing applications. The increased utility of the present invention includes, for example, table edges or tops or other components of furniture, pictures frames, and walls, ceiling, or floors of structures.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A rigid static building structure component system comprising:

a rigid building surface component formed of a plurality of upper and lower coupled cylinders, each cylinder having a circular cross sectional configuration with an axis, each cylinder having a top and a bottom and first and second sides, a single slit formed in and extending through and along the length of each cylinder;

the coupled cylinders having parallel axes, the upper coupled cylinders including an upper plane with the axes of the upper cylinders being in a common upper plane, the lower coupled cylinders including a lower plane with the axes of the lower cylinders being in a common lower plane;

the slits of the upper cylinders facing downwardly in the upper plane, the slits of the lower cylinders facing upwardly in the lower plane, the slits receiving a side of each of its adjacent cylinders, the coupled cylinders including end-most cylinders and central cylinders between the end-most cylinders, the slits of the endmost cylinders having a thickness equal to the thickness of one cylinder, the slits of the central cylinders having a thickness equal to the thickness of two cylinder, the cylinders being secured with respect to each other at their slits holding the sides of the cylinders passing through the slits.

2. The system as set forth in claim 1 wherein each of the cylinders has an exterior diameter of between 0.750 inches and 1.125 inches, each of the cylinders has a side wall with a thickness of between 0.125 inches and 0.250 inches.

3. The system as set forth in claim 1 wherein the coupled cylinders of each plane include endmost cylinders and a plurality of intermediate cylinders between the endmost cylinders.

4. The system as set forth in claim 1 wherein the rigid component is a roof covering of a building with a flexible layer with roof decking beneath the flexible layer.

5. A roof system comprising, in combination:

a plurality of essentially rigid components, each rigid component formed of a plurality of upper and lower cylinders, each of the cylinders being of a same size and shape, each of the cylinders having a circular cross sectional configuration with a central axis, each of the cylinders having an exterior diameter of between 0.750 inches and 1.125 inches, each of the cylinders having a side wall with a thickness of between 0.125 inches and 0.250 inches, each of the cylinders having a top, a bottom, a first side, and a second side, and an axial slit formed in and extending through each cylinder;

each rigid component formed by coupling a plurality of the cylinders, the coupled cylinders having their axes parallel with each other, the coupled upper cylinders including an upper plane with the axes of the upper cylinders being in a common upper plane, the coupled lower cylinders including a lower plane with the axes of the lower cylinders being in a common lower plane, the axes of the upper plane being spaced from the axes of the lower plane by a distance essentially equal to the diameter of the cylinders, the coupled cylinders of each plane including two endmost cylinders and a plurality of intermediate cylinders between the endmost cylinders;

the slits of the coupled upper cylinders facing downwardly in the upper plane, the slits of the lower cylinders facing upwardly in the lower plane, the slits of the endmost cylinders receiving one of the sides of its adjacent cylinder, the slit of the intermediate cylinders receiving one of the sides of each of its adjacent cylinders, the cylinders being secured with respect to each other at their slits holding the sides of the cylinders passing through the slits whereby all of the cylinders are held together forming the rigid component for functioning as a roof covering and providing a water resistant surface;

a thermally insulating polymer interior of the cylinders for functioning as an insulator for a building located beneath the rigid components;

each rigid component having an upper edge and an opposed lower edge, each rigid component having a side edge and an opposed side edge, each rigid component adapted to be positioned upon an liquid impervious adhesive underlayment with roof decking beneath the underlayment;

a V-shaped roof ridge cover over the upper edge of one of the rigid components and the upper edge of an adjacent rigid component;

a V-shaped roof valley cover over the side edge of one of the rigid components and the side edge of an adjacent rigid component; and a liquid impervious adhesive over the upwardly facing slits functioning to add to the structural rigidity of the system.

* * * * *